US011462231B1

(12) United States Patent
Shankar et al.

(10) Patent No.: US 11,462,231 B1
(45) Date of Patent: Oct. 4, 2022

(54) SPECTRAL SMOOTHING METHOD FOR NOISE REDUCTION

(71) Applicant: Amazon Technologies, Inc., Seattle, WA (US)

(72) Inventors: Nikhil Shankar, Richardson, TX (US); Berkant Tacer, Bellevue, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/951,175

(22) Filed: Nov. 18, 2020

(51) Int. Cl.

| | |
|---|---|
| ***G10L 21/034*** | (2013.01) |
| ***G10L 21/0232*** | (2013.01) |
| ***G10L 25/21*** | (2013.01) |
| ***G10L 25/84*** | (2013.01) |
| ***G10L 25/60*** | (2013.01) |
| *G10L 25/18* | (2013.01) |

(52) U.S. Cl.
CPC ..... *G10L 21/034* (2013.01); *G10L 21/0232* (2013.01); *G10L 25/21* (2013.01); *G10L 25/60* (2013.01); *G10L 25/84* (2013.01); *G10L 25/18* (2013.01)

(58) Field of Classification Search
CPC ..... G10L 21/034; G10L 21/0232
See application file for complete search history.

(56) References Cited

U.S. PATENT DOCUMENTS 6,122,384 A * 9/2000 Mauro ..... G10L 21/0232 381/94.3
10,043,530 B1 * 8/2018 Shi ..... H04R 3/00
2013/0282373 A1 * 10/2013 Visser ..... G10L 21/0316 704/233

OTHER PUBLICATIONS

Abd El-Moneim, S., EL-Rabaie, E. S. M., Nassar, M. A., Dessouky, M. I., Ismail, N. A., El-Fishawy, A. S., & Abd El-Samie, F. E. (2020). Speaker recognition based on pre-processing approaches. International Journal of Speech Technology, 1-8.*

* cited by examiner

*Primary Examiner* — Bryan S Blankenagel
(74) *Attorney, Agent, or Firm* — Pierce Atwood LLP

(57) ABSTRACT

A system configured to perform low input-output latency noise reduction in a frequency domain is provided. The real-time noise reduction algorithm performs frame by frame processing of a single-channel noisy acoustic signal to estimate a gain function. Accurate noise power estimates are achieved with the help of minimum statistics approach followed by a voice activity detector. The noise power and gain values are smoothed to remove any external artifacts and avoid background noise modulations. The gain values for individual frequency bands are weighted and smoothed to reduce distortion. To obtain distortionless output speech, the system performs curve fitting by separating the frequency bands into multiple groups and applying a Savitzky-Golay filter to each group. The final gain values generated by these filters are multiplied with the noisy speech signal to obtain a clean speech signal.

20 Claims, 14 Drawing Sheets

FIG. 4

Gain Computation Equations 400

First Audio Data (Time Domain) 410 → $y(n) = x(n) + d(n)\ , n = 0\ to\ N-1$

First Audio Data (Frequency Domain) 415 → $Y_k = X_k + D_k\ , k = 0\ to\ K-1$

Noise Power Estimate 420 → $\hat{\sigma}^2_{D_k}$ $\hat{\sigma}^2_{X_k}$ ← Signal Power Estimate 425

*a priori* SNR 430 → $\hat{\xi}_k = \frac{\hat{\sigma}^2_{X_k}}{\hat{\sigma}^2_{D_k}}$ $\hat{\gamma}_k = \frac{|Y_k|^2}{\hat{\sigma}^2_{D_k}}$ ← a-posteriori SNR 435

Updated Noise Power Estimate 440 → $\hat{\sigma}^2_{D_k} = \left(\alpha_n * \hat{\sigma}^2_{D_{k_{prev}}}\right) + \left((1-\alpha_n) * \hat{\sigma}^2_{MS_k}\right)$ Updated *a priori* SNR 445 → $\hat{\xi}_k = \alpha_{snr} * \frac{\hat{\sigma}^2_{X_k}}{\hat{\sigma}^2_{D_k}} + (1-\alpha_{snr}) * max(\hat{\gamma}_k - 1, 0)$ Gain Computation 450 → $G_k = \frac{\sqrt{\hat{\xi}_k}}{\mu + \sqrt{\hat{\xi}_k}}$

FIG. 5A

Noise Reduction Equations 510

Conditions 520 → Noise only frame, and $G_k > \min(G) * \delta$

Noise Reduction 525 → $G_k = G_k/\lambda_{nr}$

FIG. 5B

Gain Weighting Equations 530

Frequency Range 540 → k = 0 to $M_1$

Gain Weighting 545 → $G_k = G_k * \lambda_l$

Frequency Range 550 → k = $M_1$ to $M_2$

Gain Weighting 555 → $G_k = G_k * \lambda_m$

Frequency Range 560 → k = $M_2$ to K/2

Gain Weighting 565 → $G_k = G_k/\lambda_h$

FIG. 5C

Smoothing Equation 570

Frequency Range 580 → k = 0 to K/2

Smoothing 585 → $G_k = \left(\alpha_g * G_{k_{prev}}\right) + \left(\left(1 - \alpha_g\right) * G_k\right)$

FIG. 7

Savitzky-Golay Filtering 700

Weighting Coefficients 710

$$(A_{-n}, A_{-(n-1)}, \ldots, A_{n-1}, A_n)$$

Savitzky-Golay Equation 720

$$(G_k)_s = \frac{\sum_{i=-n}^{n} A_i G_{k+i}}{\sum_{i=-n}^{n} A_i}, k = 0 \text{ to } K/2$$

SPECTRAL SMOOTHING METHOD FOR NOISE REDUCTION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

FIG. 4 illustrates examples of equations used to perform gain computation according to embodiments of the present disclosure.

FIGS. 5A-5C illustrate examples of equations used to perform noise reduction, gain weighting, and smoothing according to embodiments of the present disclosure.

FIG. 7 illustrates an example equation used to perform Savitzky-Golay filtering according to embodiments of the present disclosure.

DETAILED DESCRIPTION

Figure 1:
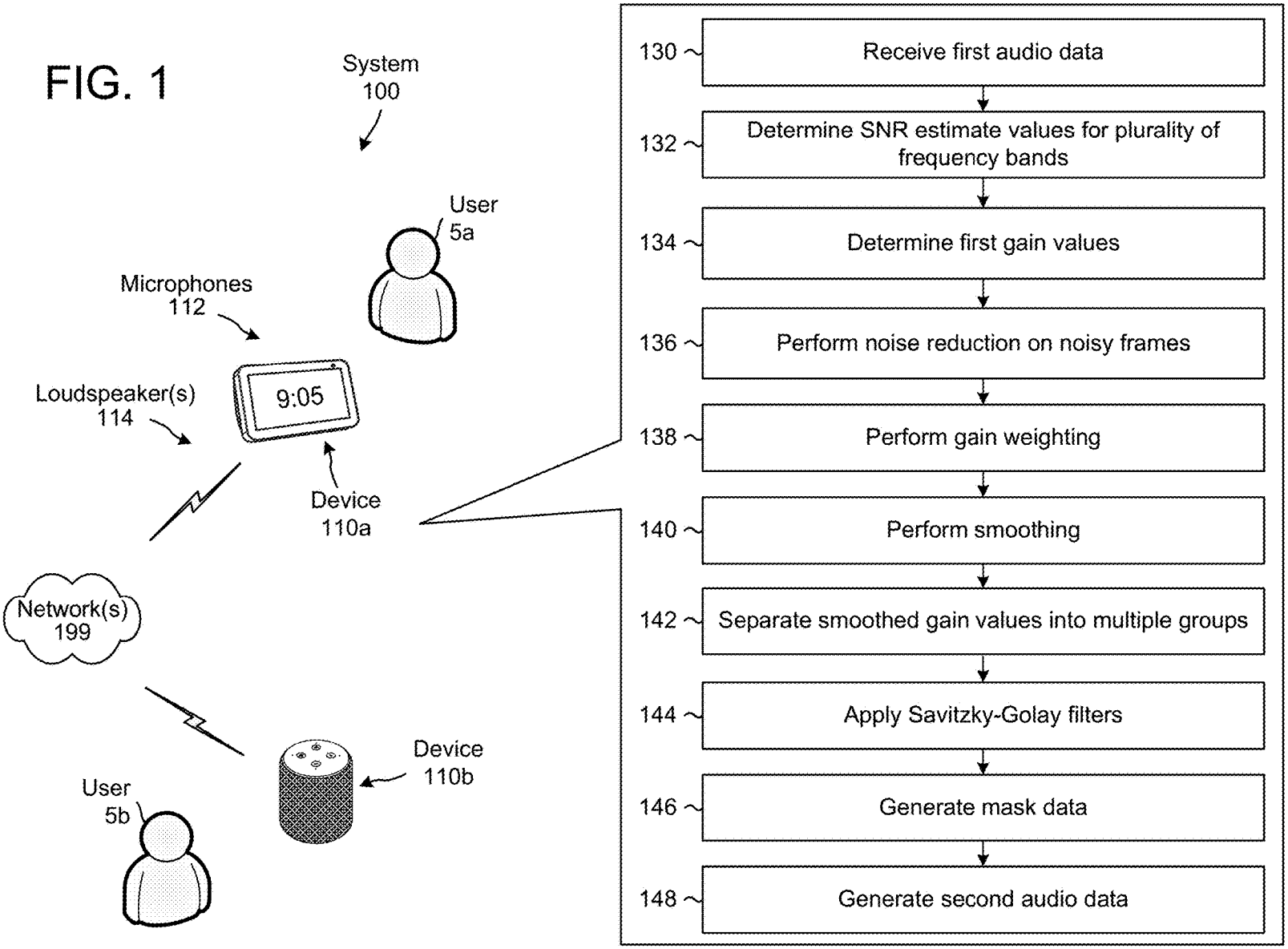
FIG. 1 illustrates a system according to embodiments of the present disclosure.

Electronic devices may be used to capture and process audio data. The audio data may be used for voice commands and/or may be sent to a remote device as part of a communication session. During a communication session, electronic devices may perform noise reduction and/or other processing to isolate speech represented in output audio data. In some examples, conventional devices may perform noise reduction using a wiener filter to suppress stationary noise. For example, conventional devices may derive a gain function that acts as a mask value to suppress the amount of noise or to enhance speech, depending on the input frame. Thus, the gain function is multiplied by the microphone audio data to generate output audio data that removes background noise and/or isolates the speech.

Conventional devices may determine the gain function by estimating a noise spectrum. This estimation is dependent on a voice activity detector (VAD) configured to classify between speech frames and noise input frames. Due to wrong estimations of the noise frames, conventional devices generate inaccurate estimations of the noise power, reducing a signal quality of and/or increasing distortion represented in the output audio data. The noise suppression due to the wiener filter approach may also introduce external artifacts such as musical noise and reverberation effects in the output audio data. As the signal-to-noise ratio (SNR) goes down, the background noise is modulated as well. Examples of conventional single-channel noise reduction algorithms include Minimum mean square error (MMSE) and Maximum a posteriori estimation (MAP) based estimations. These algorithms are dependent on prior data and assumptions between speech and background noise, which impacts the signal quality of and/or amount of distortion represented in the output audio data.

To improve noise reduction for a single channel input, devices, systems and methods are disclosed that perform noise reduction using techniques such as curve fitting to smooth the gain function and obtain improved results. A device performs frame by frame processing of a single-channel noisy acoustic signal to generate noise power estimates and signal-to-noise ratio (SNR) estimates for different frequency bands. Using these estimates, the device determines gain values associated with each of the different frequency bands. To obtain distortionless output speech, the device modifies the gain values to reduce variations and emphasize the speech. The device uses conventional techniques to generate modified gain values, such as noise reduction, gain weighting, and smoothing. The device then applies curve fitting to the modified gain values to generate smoothened gain values. For example, the device may split the modified gain values into three or more groups and may apply a separate Savitzky-Golay filter to each group to perform a least square fit and remove sudden spikes (e.g., generate a best fit curve for each of the groups). The smoothened gain values generated by the Savitzky-Golay filters are concatenated to generate mask data, which can be used to generate output audio data representing isolated speech.

FIG. 1 illustrates a high-level conceptual block diagram of a system 100 configured to perform noise reduction according to embodiments of the disclosure. Although FIG. 1 and other figures/discussion illustrate the operation of the system in a particular order, the steps described may be performed in a different order (as well as certain steps removed or added) without departing from the intent of the disclosure. As illustrated in FIG. 1, the system 100 may include a first device 110*a* that may be communicatively coupled to network(s) 199 and may include microphones 112 in a microphone array and/or one or more loudspeaker(s) 114. However, the disclosure is not limited thereto and the first device 110*a* may include additional components without departing from the disclosure. In addition, FIG. 1 illustrates that the system 100 may include a second device 110*b* that may also be communicatively coupled to the network(s) 199, although the disclosure is not limited thereto.

While FIG. 1 illustrates the loudspeaker(s) 114 being internal to the first device 110*a*, the disclosure is not limited thereto and the loudspeaker(s) 114 may be external to the first device 110*a*without departing from the disclosure. For example, the loudspeaker(s) 114 may be separate from the first device 110*a* and connected to the first device 110*a* via a wired connection and/or a wireless connection without departing from the disclosure.

The first device 110*a* may be an electronic device configured to generate output audio and/or send audio data to a remote device (e.g., second device 110*b*). For example, a first user 5*a* of the first device 110*a* may participate in a communication session with a second user 5*b* of the second device 11*b* via the network(s) 199. Thus, the first device 110*a* may receive first audio data from the second device 110*b* and may generate playback audio for the first user 5*a* using the loudspeaker(s) 114 and the first audio data. The first device 110*a* may also generate second audio data representing speech generated by the first user 5*a* using the microphones 112 and may send the second audio data to the second device 110*b* via the network(s) 199.

As part of generating the second audio data, the first device 110*a* may be configured to perform low input-output latency noise reduction in a frequency domain. For example, a real-time noise reduction algorithm may perform frame by frame processing of a single-channel noisy acoustic signal to estimate a gain function. As described in greater detail below, the first device 110*a* may use a minimum statistics approach followed by a voice activity detector to achieve accurate noise power estimates. The first device 110*a* may smooth the noise power estimates and the gain values to remove any external artifacts and avoid background noise modulations. The first device 110*a* may perform noise reduction, gain weighting, and/or smoothing to the gain values for individual frequency bands to reduce distortion and generate modified gain values.

To obtain distortionless output speech, the first device 110*a* may also perform curve fitting to the modified gain values to generate final gain values. For example, the first device 110*a* may separate the modified gain values into three or more groups of frequency bands and may separately apply Savitzky-Golay filter(s) to the groups to perform a least square fit and remove sudden spikes (e.g., generate a best fit curve for each of the groups). The first device 110*a* may concatenate the final gain values generated by the Savitzky-Golay filters to generate mask data, which can be used to generate output audio data representing isolated speech. For example, the first device 110*a* may multiply the mask data (e.g., final gain values) and the noisy speech signal to obtain a clean speech signal.

As described in greater detail below, the first device 110*a* may apply a Savitzky-Golay filter to an individual group of modified gain values to give an estimate of a smoothed signal. For example, the first device 110*a* may select a first series of gain values from the group of modified gain values (e.g., sequence of m gain values centered on a first frequency band) and may perform a first convolution operation by multiplying the first series of gain values by convolution coefficient values associated with the Savitzky-Golay filter. Thus, the first convolution operation generates a first final gain value associated with the first frequency band. Similarly, the first device 110*a* may select a second series of gain values from the group of modified gain values (e.g., sequence of m gain values centered on a second frequency band) and may perform a second convolution operation by multiplying the second series of gain values by the convolution coefficient values to generate a second final gain value associated with the second frequency band. Thus, the first device 110*a* may iteratively convolve a portion of the modified gain values and the convolution coefficient values to generate the final gain values.

As illustrated in FIG. 1, the first device 110*a* may receive (130) first audio data corresponding to a first microphone. As part of receiving the first audio data, the first device 110*a* may convert the first audio data from a time domain to a frequency domain, such that the first audio data corresponds to a plurality of frequency bands. The first device 110*a* may determine (132) signal-to-noise ratio (SNR) estimate values for each of the plurality of frequency bands and may determine (134) first gain values associated with the SNR estimate values. For example, the first device 110*a* may use minimum statistics and/or a voice activity detector (VAD) to determine whether an audio frame corresponds to noise or to speech. If the audio frame corresponds to noise, the first device 110*a* may update noise estimates in each of the frequency bands, whereas if the audio frame corresponds to speech the first device 110*a* may update signal estimates in each of the frequency bands. The first device 110*a* may use the noise estimates and the signal estimates to calculate SNR estimate values and may use the SNR estimate values to determine the first gain values, as described in greater detail below with regard to FIG. 4.

The first device 110*a* may perform (136) noise reduction on noisy frames. For example, the first device 110*a* may identify audio frames associated with noise and may reduce the first gain values by a noise reduction weight value, as described below with regard to FIG. 5A. The first device 110*a* may perform (138) gain weighting and perform (140) smoothing to generate smoothed gain values. For example, the first device 110*a* may perform gain weighting to increase a first portion of the first gain values associated with low frequency bands and decrease a second portion of the first gain values associated with high frequency bands, as described in greater detail below with regard to FIGS. 5B and 6. The first device 110*a* may perform smoothing using a smoothing equation, as described in greater detail below with regard to FIG. 5C.

After generating the smoothed gain values, the first device 110*a* may separate (142) the smoothed gain values into multiple groups and may apply (144) Savitzky-Golay filters. For example, the first device 110*a* may separate the smoothed gain values into three groups, a first group associated with low frequency bands, a second group associated with medium frequency bands, and a third group associated with high frequency bands, although the disclosure is not limited thereto. In some examples, the first device 110*a* may separately apply a Savitzky-Golay filter to the first group, the second group, and then the third group to generate the final gain values. However, the disclosure is not limited thereto, and in other examples the first device 110*a* may apply a first Savitzky-Golay filter to the first group, a second Savitzky-Golay filter to the second group, and a third Savitzky-Golay filter to the third group without departing from the disclosure. Thus, the first device 110*a* may apply any number of Savitzky-Golay filters without departing from the disclosure, and a number of convolution coefficient values may vary between the Savitzky-Golay filters.

The first device 110*a* may generate (146) mask data by concatenating the final gain values associated with the groups and may generate (148) second audio data. For example, the first device 110*a* may multiply the mask data by the first audio data to generate the second audio data, although the disclosure is not limited thereto. The first device 110*a* may then send the second audio data to the second device 110*b* as part of the communication session. However, the disclosure is not limited thereto and in some examples the first device 110*a* may perform additional processing on the second audio data prior to sending to the second device 110*b* without departing from the disclosure.

An audio signal is a representation of sound and an electronic representation of an audio signal may be referred to as audio data, which may be analog and/or digital without departing from the disclosure. For ease of illustration, the disclosure may refer to either audio data (e.g., far-end reference audio data or playback audio data, microphone audio data, near-end reference data or input audio data, etc.) or audio signals (e.g., playback signal, far-end reference signal, microphone signal, near-end reference signal, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

In some examples, the audio data may correspond to audio signals in the time-domain. However, the disclosure is not limited thereto and the device 110 may convert these signals to the frequency-domain or subband-domain prior to performing additional processing, as illustrated below with regard to FIG. 3. For example, the device 110 may convert the time-domain signal to the frequency-domain using a Fast Fourier Transform (FFT) and/or the like. Additionally or alternatively, the device 110 may convert the time-domain signal to the subband-domain by applying a bandpass filter or other filtering to select a portion of the time-domain signal within a desired frequency range.

As used herein, audio signals or audio data (e.g., far-end reference audio data, near-end reference audio data, microphone audio data, or the like) may correspond to a specific range of frequency bands. For example, far-end reference audio data and/or near-end reference audio data may correspond to a human hearing range (e.g., 20 Hz-20kHz), although the disclosure is not limited thereto.

As used herein, a frequency band corresponds to a frequency range having a starting frequency and an ending frequency. Thus, the total frequency range may be divided into a fixed number (e.g., 256, 512, etc.) of frequency ranges, with each frequency range referred to as a frequency band and corresponding to a uniform size. However, the disclosure is not limited thereto and the size of the frequency band may vary without departing from the disclosure.

Playback audio data (e.g., far-end reference signal) corresponds to audio data that will be output by the loudspeaker(s) 114 to generate playback audio. For example, the first device 110*a* may stream music or output speech associated with a communication session (e.g., audio or video telecommunication). In some examples, the playback audio data may be referred to as far-end reference audio data, loudspeaker audio data, and/or the like without departing from the disclosure. For ease of illustration, the following description will refer to this audio data as playback audio data or reference audio data. As noted above, the playback audio data may be referred to as playback signal(s) without departing from the disclosure.

Microphone audio data corresponds to audio data that is captured by one or more microphones 112 of the first device 110*a*. The microphone audio data may include local speech x(t) (e.g., an utterance, such as near-end speech generated by the user 5), an "echo" signal y(t) (e.g., portion of the playback audio captured by the microphones 112), acoustic noise d(t) (e.g., ambient noise in an environment around the first device 110*a*), and/or the like. As the microphone audio data is captured by the microphones 112 and captures audio input to the first device 110*a*, the microphone audio data may be referred to as input audio data, near-end audio data, and/or the like without departing from the disclosure. For ease of illustration, the following description will refer to this signal as microphone audio data. As noted above, the microphone audio data may be referred to as a microphone signal without departing from the disclosure.

Figure 2A:
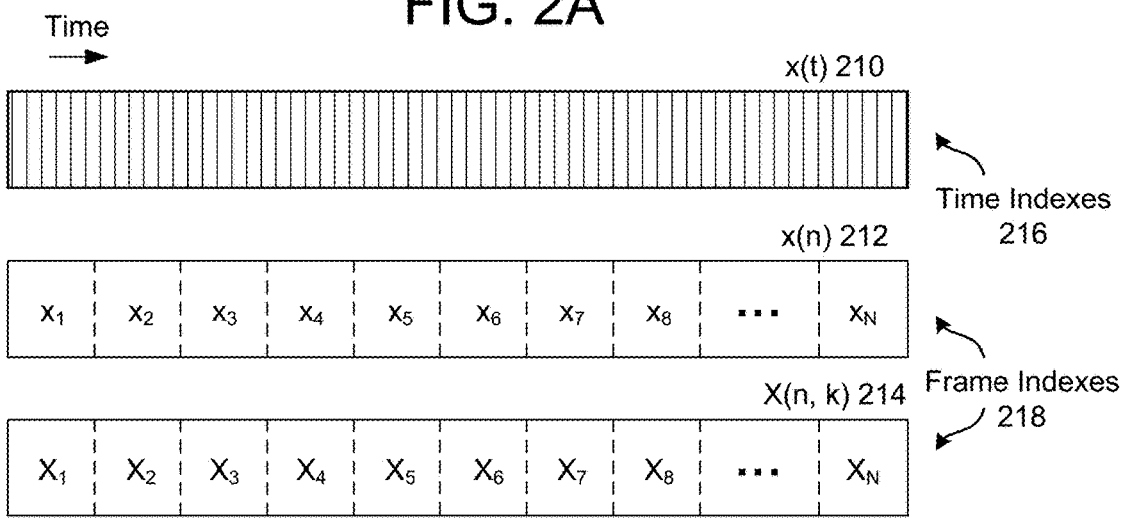
FIGS. 2A-2D illustrate examples of frame indexes, tone indexes, and channel indexes.

FIGS. 2A-2D illustrate examples of frame indexes, tone indexes, and channel indexes. As described above, the device 110 may generate microphone audio data xm(t) using microphone(s) 112. For example, a first microphone 112*a* may generate first microphone audio data xml(t) in a time domain, a second microphone 112*b* may generate second microphone audio data xm2(t) in the time domain, and so on. As illustrated in FIG. 2A, a time domain signal may be represented as microphone audio data x(t) 210, which is comprised of a sequence of individual samples of audio data. Thus, x(t) denotes an individual sample that is associated with a time t.

While the microphone audio data x(t) 210 is comprised of a plurality of samples, in some examples the device 110 may group a plurality of samples and process them together. As illustrated in FIG. 2A, the device 110 may group a number of samples together in a frame to generate microphone audio data x(n) 212. As used herein, a variable x(n) corresponds to the time-domain signal and identifies an individual frame (e.g., fixed number of samples s) associated with a frame index n.

Additionally or alternatively, the device 110 may convert microphone audio data x(n) 212 from the time domain to the frequency domain or subband domain. For example, the device 110 may perform Discrete Fourier Transforms (DFTs) (e.g., Fast Fourier transforms (FFTs), short-time Fourier Transforms (STFTs), and/or the like) to generate microphone audio data X(n, k) 214 in the frequency domain or the subband domain. As used herein, a variable X(n, k) corresponds to the frequency-domain signal and identifies an individual frame associated with frame index n and tone index k. As illustrated in FIG. 2A, the microphone audio data x(t) 210 corresponds to time indexes 216, whereas the microphone audio data x(n) 212 and the microphone audio data X(n, k) 214 corresponds to frame indexes 218.

A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the microphone audio data X(n). However, the disclosure is not limited thereto and the system 100 may instead perform short-time Fourier transform (STFT) operations without departing from the disclosure. A short-time Fourier transform is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "k" is a frequency index (e.g., frequency bin).

FIG. 2A illustrates an example of time indexes 216 (e.g., microphone audio data x(t) 210) and frame indexes 218 (e.g., microphone audio data x(n) 212 in the time domain and microphone audio data X(n, k) 216 in the frequency domain). For example, the system 100 may apply FFT processing to the time-domain microphone audio data x(n) 212, producing the frequency-domain microphone audio data X(n, k) 214, where the tone index "k" (e.g., frequency index) ranges from 0 to K and "n" is a frame index ranging from 0 to N. As illustrated in FIG. 2A, the history of the values across iterations is provided by the frame index "n", which ranges from 1 to N and represents a series of samples over time.

Figure 2B:
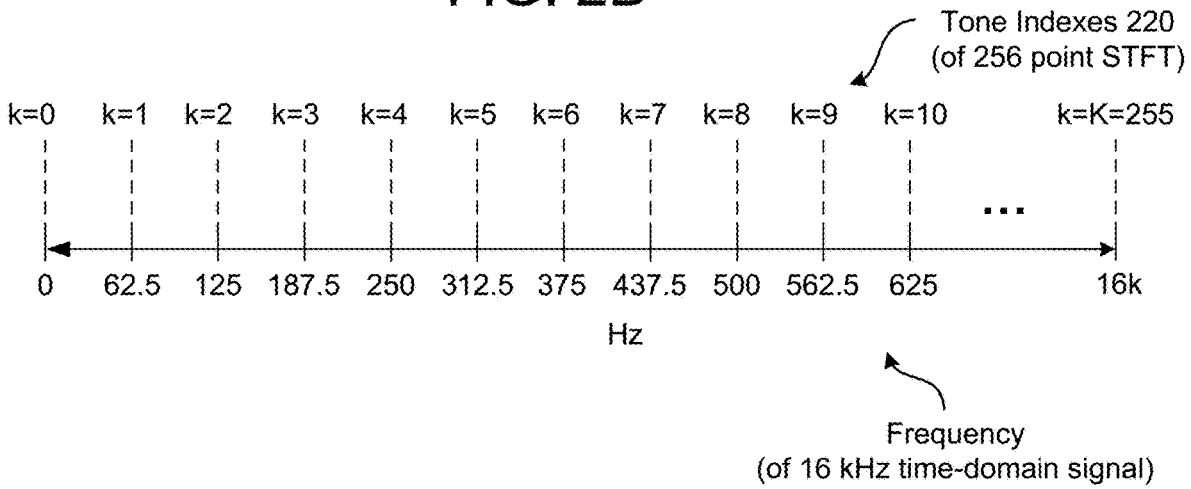

FIG. 2B illustrates an example of performing a K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 2B illustrates the frequency range being divided into 256 different subbands (e.g., tone indexes), the disclosure is not limited thereto and the system 100 may divide the frequency range into K different subbands (e.g., K indicates an FFT size). While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

Figure 2C:
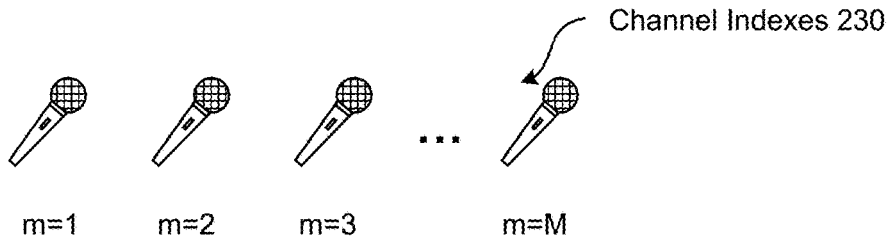

The system 100 may include multiple microphone(s) 112, with a first channel m corresponding to a first microphone 112*a*, a second channel (m+1) corresponding to a second microphone 112*b*, and so on until a final channel (MP) that corresponds to microphone 112M. FIG. 2C illustrates channel indexes 230 including a plurality of channels from channel ml to channel M. While many drawings illustrate two channels (e.g., two microphones 112), the disclosure is not limited thereto and the number of channels may vary. For the purposes of discussion, an example of system 100 includes "M" microphones 112 (M>1) for hands free near-end/far-end distant speech recognition applications.

While FIGS. 2A-2D are described with reference to the microphone audio data xm(t), the disclosure is not limited thereto and the same techniques apply to the playback audio data xr(t) without departing from the disclosure. Thus, playback audio data xr(t) indicates a specific time index t from a series of samples in the time-domain, playback audio data xr(n) indicates a specific frame index n from series of frames in the time-domain, and playback audio data Xr(n,k) indicates a specific frame index n and frequency index k from a series of frames in the frequency-domain.

Prior to converting the microphone audio data xm(n) and the playback audio data xr(n) to the frequency-domain, the device 110 must first perform time-alignment to align the playback audio data xr(n) with the microphone audio data xm(n). For example, due to nonlinearities and variable delays associated with sending the playback audio data xr(n) to the loudspeaker(s) 114 using a wireless connection, the playback audio data xr(n) is not synchronized with the microphone audio data xm(n). This lack of synchronization may be due to a propagation delay (e.g., fixed time delay) between the playback audio data xr(n) and the microphone audio data xm(n), clock jitter and/or clock skew (e.g., difference in sampling frequencies between the device 110 and the loudspeaker(s) 114), dropped packets (e.g., missing samples), and/or other variable delays.

To perform the time alignment, the device 110 may adjust the playback audio data xr(n) to match the microphone audio data xm(n). For example, the device 110 may adjust an offset between the playback audio data xr(n) and the microphone audio data xm(n) (e.g., adjust for propagation delay), may add/subtract samples and/or frames from the playback audio data xr(n) (e.g., adjust for drift), and/or the like. In some examples, the device 110 may modify both the microphone audio data and the playback audio data in order to synchronize the microphone audio data and the playback audio data. However, performing nonlinear modifications to the microphone audio data results in first microphone audio data associated with a first microphone to no longer be synchronized with second microphone audio data associated with a second microphone. Thus, the device 110 may instead modify only the playback audio data so that the playback audio data is synchronized with the first microphone audio data.

While FIG. 2A illustrates the frame indexes 218 as a series of distinct audio frames, the disclosure is not limited thereto. In some examples, the device 110 may process overlapping audio frames and/or perform calculations using overlapping time windows without departing from the disclosure. For example, a first audio frame may overlap a second audio frame by a certain amount (e.g., 80%), such that variations between subsequent audio frames are reduced. Additionally or alternatively, the first audio frame and the second audio frame may be distinct without overlapping, but the device 110 may determine power value calculations using overlapping audio frames. For example, a first power value calculation associated with the first audio frame may be calculated using a first portion of audio data (e.g., first audio frame and n previous audio frames) corresponding to a fixed time window, while a second power calculation associated with the second audio frame may be calculated using a second portion of the audio data (e.g., second audio frame, first audio frame, and n-1 previous audio frames) corresponding to the fixed time window. Thus, subsequent power calculations include n overlapping audio frames.

Figure 2D:
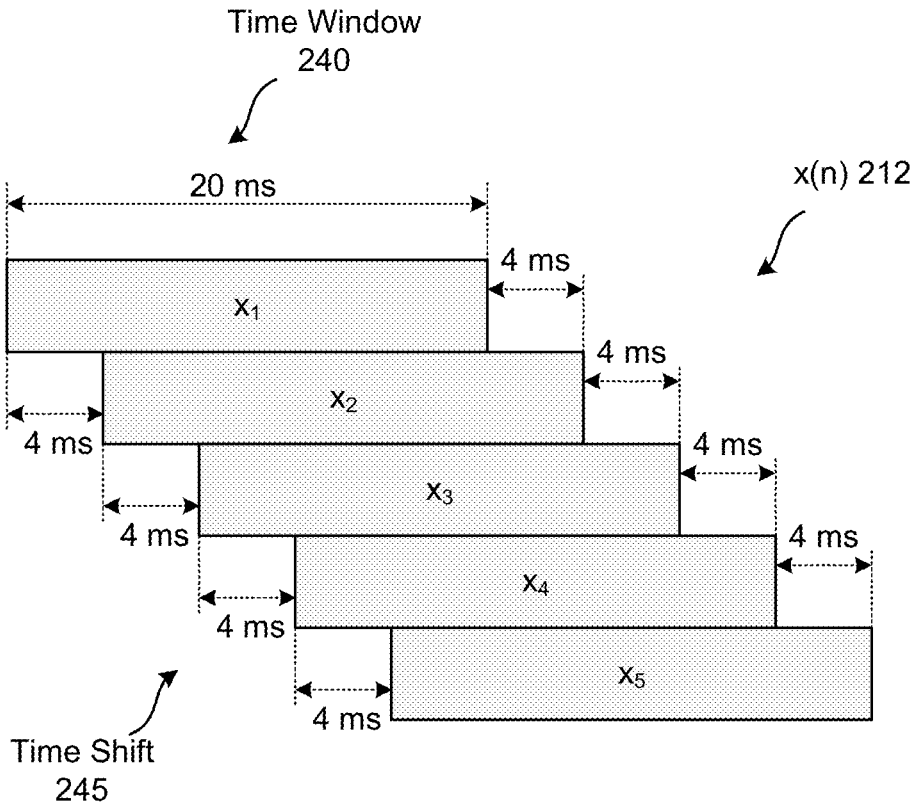

As illustrated in FIG. 2D, overlapping audio frames may be represented as overlapping audio data associated with a time window 240 (e.g., 20 ms) and a time shift 245 (e.g., 4 ms) between neighboring audio frames. For example, a first audio frame $x_1$ may extend from 0 ms to 20 ms, a second audio frame $x_2$ may extend from 4 ms to 24 ms, a third audio frame $x_3$ may extend from 8 ms to 28 ms, and so on. Thus, the audio frames overlap by 80%, although the disclosure is not limited thereto and the time window 240 and the time shift 245 may vary without departing from the disclosure.

Figure 3:
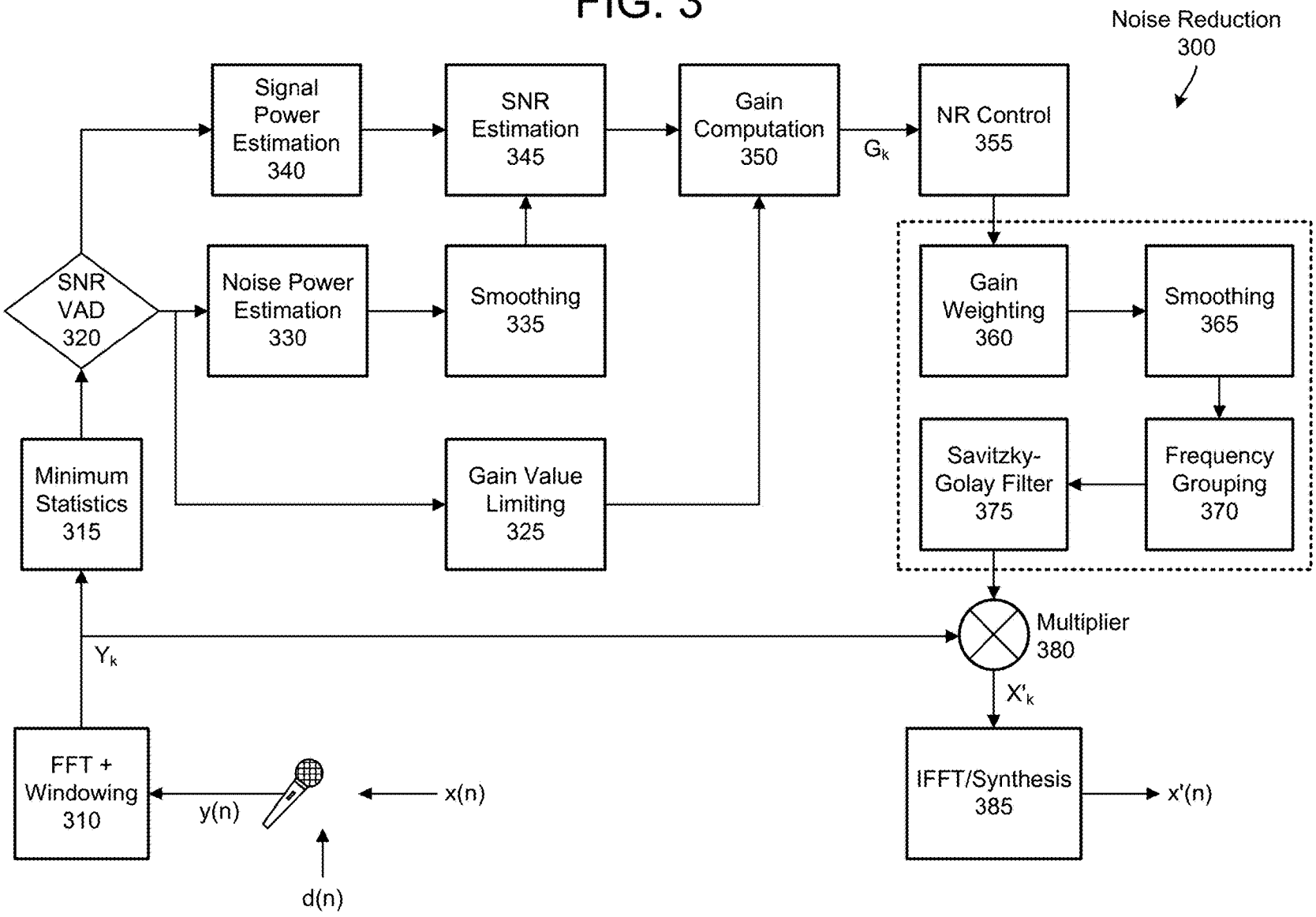
FIG. 3 illustrates an example component diagram for performing noise reduction according to embodiments of the present disclosure.

FIG. 3 illustrates an example component diagram for performing noise reduction according to embodiments of the present disclosure. As illustrated in FIG. 3, a user 5 talking will be considered an input speech source and will include some background noise. For example, first audio data y(n) captured by the microphones 112 may include speech x(n) and noise d(n). The noise that is mixed with the speech can be either stationary or non-stationary in nature, and will also consist of reverberations and additional echoes.

For real-time processing of the input signal, an overlap-add approach between the incoming frames is considered along with windowing of the frames. As illustrated in FIG. 3, the device 110 may perform FFT+Windowing 310, which may include applying a short-time Fourier Transform (STFT) to convert the first audio data from the time domain to the frequency domain.

FIG. 4 illustrates examples of equations used to perform gain computation according to embodiments of the present disclosure. For example, mathematically the above description can be explained as follows:

$$y(n)=x(n)+d(n) \quad [1]$$

where y(n) is the first audio data (time domain) 410, x(n) is the speech signal, and d(n) is the noise signal, n=0 to N−1, and N is frame size in samples. Thus, Equation [1] is the additive mixture model of noisy speech y(n), which includes clean speech x(n) and noise d(n).

Applying STFT to Equation [1] yields:

$$Y_k=X_k+D_k \quad [2]$$

where $Y_k$ is the first audio data (frequency domain) 415, $X_k$ is the speech signal, $D_k$ is the noise signal in the frequency domain, k=0 to K−1 is the frequency bin representation, and K is STFT size. In polar coordinates, Equation [2] is given by:

$$|Y_k|e^{j\theta_{yk}}=|X_k|e^{j\theta_{Xk}}+|D_k|e^{j\theta_{Dk}} \quad [3]$$

where $|Y_k|$, $|X_k|$, and $|D_k|$ are magnitude spectrums of noisy speech, clean speech and noise respectively, $\theta_{y_k}$, $\theta_{X_k}$, and $\theta_{D_k}$ are the phase spectrums of noisy speech, clean speech and noise respectively.

Existing single-channel noise reduction techniques have certain limitations when it comes to real-time processing. A first limitation is that the enhanced speech output includes speech distortions. A second limitation is the presence of external artifacts such as reverb effects and musical noise effects in the output audio data. In addition, the existing noise reduction techniques modulate the background noise. Finally, the VAD may fail to accurately classify between speech and noise in noisy environments, leading to incorrect estimations of the noise power estimates.

The device 110 may calculate minimum statistics 315 using the frequency domain signals to determine a magnitude and phase of the input noisy speech. For example, the device 110 may pass the input noisy speech magnitude power ($|Y_k|^2$) of the microphone through a minimum statistics module. The device 110 may estimate noise power spectral density (PSD) based on optimal smoothing and minimum statistics. Thus, the device 110 may track the spectral minima in each frequency band without any classification between speech and noise. The device 110 may derive an optimal smoothing parameter by minimizing the conditional mean square estimation error criterion, which may help in recursive smoothing of the noisy input speech PSD. From the obtained smoothened PSD, and by analysis of the spectral minima statistics, the device 110 may implement an unbiased noise estimator for real-time processing. For non-stationary noise types (e.g., where the background noise keeps changing), the device 110 may speed up the tracking of the spectral minima.

The device 110 may pass the noisy speech magnitude spectrum through a simple energy-based SNR VAD 320, which classifies audio frames as noise only frames and speech frames. Thus, the estimates of noise and signal are obtained from the minimum statistics module and then passed to the SNR based VAD. The device 110 may then compute an a priori SNR 430 and an a-posteriori SNR 435. As illustrated in FIG. 4, $$\hat{\xi}_k = \frac{\hat{\sigma}^2_{X_k}}{\hat{\sigma}^2_{D_k}}$$

is the a priori SNR 430, $$\hat{\gamma}_k = \frac{|Y_k|^2}{\hat{\sigma}^2_{D_k}}$$

is the a-posteriori SNR 435, $\hat{\sigma}^2_{D_k}$ is the noise power estimate 420, and $\hat{\sigma}^2_{X_k}$ is the enhanced output speech power estimate 425 from a previous audio frame.

The VAD decision is computed mathematically as follows, $$vad_{decision} = \frac{\text{sum}\left(\hat{\gamma}_k * \left(\frac{\hat{\xi}_k}{1+\hat{\xi}_k}\right) - \log\left(1+\hat{\xi}_k\right)\right)}{\left(\frac{K}{2}+1\right)}, k = 0 \text{ to } K/2 \quad [4]$$

If the SNR VAD 320 classifies an audio frame as a noise only frame, the device 110 may perform noise power estimation 330 to determine noise power estimates and perform smoothing 335 to generate smoothed noise power estimates. In addition, the device 110 may perform gain value limiting 325 to prevent gain value(s) from exceeding a gain value limit. In contrast, if the SNR VAD 320 classifies the audio frame as a speech frame, the device 110 may perform signal power estimation 340 to determine signal power estimates.

For speech only frames detected by the VAD decision, the device 110 may implement a hangover time of 15 audio frames to avoid incorrect noise estimates during speech presence at lower SNR background noise. The initial training frames are assumed to be noise and the device 110 may calculate the noise power estimate using these initial training frames. This noise power estimate is then updated and smoothened whenever the VAD detects the incoming frame to be noise. In some examples, the number of training frames may be equal to six, although the disclosure is not limited thereto. The device 110 may update and smooth the noise power estimate as shown by updated noise power estimate 440:

$$\hat{\sigma}^2_{D_K}=(\alpha_n*\hat{\sigma}^2_{D_{kprev}})+((1-\alpha_n)*\hat{\sigma}^2_{MS_k}), k=0 \text{ to } K/2 \quad [5]$$

where $\alpha_n$=0.99, $\hat{\sigma}^2_{D_{Kprev}}$ is the noise power estimate of the previous noise frame, and $\hat{\sigma}^2_{MS_k}$ is the noise power estimate from the minimum statistics block, although the disclosure is not limited thereto.

Using the signal power estimates and the smoothed noise power estimates, the device 110 may perform SNR estimation 345 to calculate SNR estimate values. However, the disclosure is not limited thereto and the device 110 may calculate other signal quality metrics without departing from the disclosure. The device 110 may use the SNR estimate values and the gain value limit to perform gain computation 350 to determine first gain values.

The updated noise estimate is used to compute an updated a priori SNR 445 and the a-posteriori SNR 435. For example, the device 110 may calculate the updated a priori SNR 445 using a decision directed approach:

$$\hat{\xi}_k = \alpha_{snr} * \frac{\hat{\sigma}^2_{X_k}}{\hat{\sigma}^2_{D_k}} + (1 - \alpha_{snr}) * \max(\hat{\gamma}_k - 1, 0), k = 0 \text{ to } K/2 \quad [7]$$

where $\alpha_{snr}$=0.98, although the disclosure is not limited thereto. The device 110 may use the a priori SNR 445 to derive a wiener filter gain/mask function with a tunable parameter μ to control an amount of noise reduction. For example, the gain function (e.g., gain computation 450) is given by:

$$G_k = \frac{\sqrt{\hat{\xi}_k}}{\mu + \sqrt{\hat{\xi}_k}}, k = 0 \text{ to } K/2 \quad [8]$$

where μ=1.5, although the disclosure is not limited thereto. Instead, the device 110 may vary the value of μ to control the amount of noise reduction (e.g., increasing the value of μ suppresses more noise).

FIGS. 5A-5C illustrate examples of equations used to perform noise reduction, gain weighting, and smoothing according to embodiments of the present disclosure. Once the device 110 calculates the gain function to suppress background noise, the device 110 may focus on making sure that the enhanced speech output does not contain any speech distortions or external artifacts. For example, the device 110 may perform noise reduction (NR) control 355 to minimize the gain values in noise only frames so as to avoid sudden peaks or any modulated noise in the background. The mathematical representation of noise reduction equations 510 includes conditions 520 (e.g., if noise only frame and $G_k$>min(G)* δ) and noise reduction 525, illustrated in Equation [9]:

$$G_k = G_k / \lambda_{nr} \quad [9]$$

where k=0 to K/2, δ denotes a minimum factor (e.g., δ=4), and $\lambda_{nr}$ denotes a first weight value (e.g., $\lambda_{nr}$=1.5), although the disclosure is not limited thereto.

Later, the device 110 may perform gain weighting 360 to weight frequency gain values to avoid speech distortions in the enhanced speech. This is done by splitting the frequency bins into three frequency ranges (e.g., low frequency range, medium frequency range, and high frequency range) and applying different weight values to each of the frequency ranges. For example, the device 110 may multiply gain values associated with the low frequency range by a first weight value to give more prominence to lower frequency regions that represent speech. Additionally or alternatively, the device 110 may divide second gain values associated with the high frequency range by a second weight value to suppress more noise in the higher frequency regions.

The mathematical representation is illustrated as gain weighting equations 530:

$$G_k = G_k * \lambda_l \text{ where } k=0 \text{ to } M_1 \quad [10.1]$$

$$G_k = G_k * \lambda_m \text{ where } k=M_1 \text{ to } M_2 \quad [10.2]$$

$$G_k = G_k / \lambda_h \text{ where } k=M_2 \text{ to } K/2 \quad [10.3]$$

where $\lambda_1$ is a second weight value (e.g., $\lambda_l$ =1.1) associated with first gain weighting 545 for a first frequency range 540, $\lambda_m$is a third weight value (e.g., $\lambda_m$=1.0) associated with second gain weighting 555 for a second frequency range 550, and $\lambda_h$ is a fourth weight value (e.g., $\lambda_h$=1.05) associated with third gain weighting 565 for a third frequency range 560, although the disclosure is not limited thereto. In some examples, the device 110 may use a first FFT size (e.g., K=256), a first frequency cutoff (e.g., $M_1$=19), and a second frequency cutoff (e.g., $M_2$ =44), although the disclosure is not limited thereto. The device 110 may vary the above tunable parameters to achieve satisfactory results. For example, the parameters may be set after several iterations to identify optimized values. The device 110 may sample the audio signals using a 16 KHz sampling frequency, although the disclosure is not limited thereto.

Finally, the device 110 may perform smoothing 365, such that the gain function is smoothened with respect to previous frame mask, to remove any additional spikes or speech distortions. As illustrated in FIG. 5C, smoothing equation 570 is applied within a frequency range 580 (e.g., k=0 to K/2). For example, the device 110 may set a smoothing parameter $\alpha_g$ (e.g., $\alpha_g$=0.5) and the updated gain is given by smoothing 585.

$$G_k = (\alpha_g * G_{k_{prev}}) + ((1 - a_g) * G_k), k=0 \text{ to } K/2 \quad [11]$$

Figure 6:
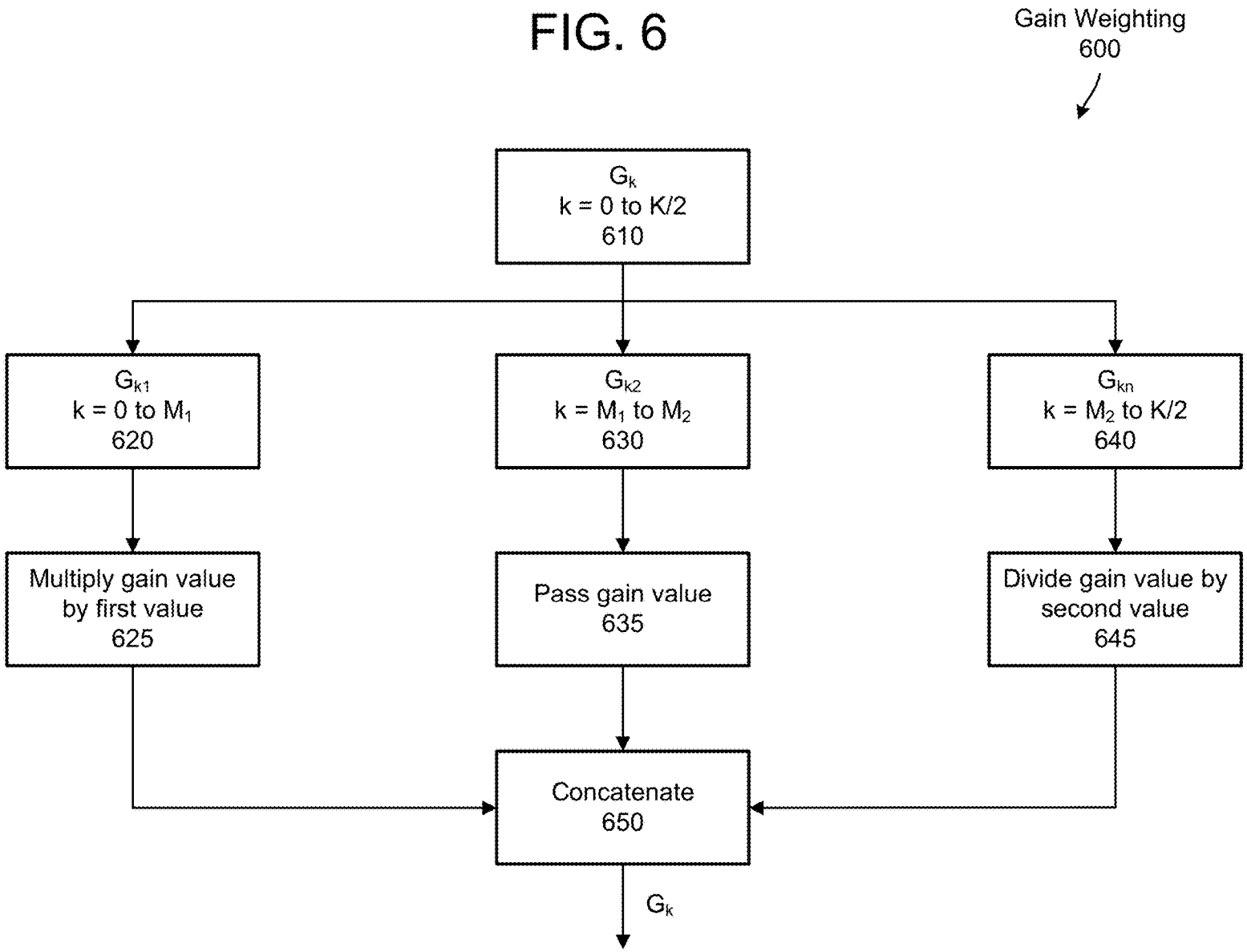
FIG. 6 illustrates an example of performing gain weighting according to embodiments of the present disclosure.

FIG. 6 illustrates an example of performing gain weighting according to embodiments of the present disclosure. As illustrated in FIG. 6, during gain weighting 600 the device 110 may receive (610) input gain values Gk (where k=0 to K/2), split the frequency bins into three frequency ranges (e.g., low frequency range, medium frequency range, and high frequency range), and apply different weight values to each of the frequency ranges. For example, the device 110 may determine (620) first gain values $G_{k1}$ associated with the first frequency range 540 (e.g., low frequency range, such as k=0 to $M_1$) and multiply (625) each of the first gain values $G_{k1}$ by a first value (e.g., second weight value $\lambda_1$) to give more prominence to lower frequency regions that represent speech. Similarly, the device 110 may determine (630) second gain values $G_{k2}$associated with the second frequency range 550 (e.g., medium frequency range, such as k=$M_1$ to $M_2$) and multiply (635) each of the second gain values $G_{k2}$ by a pass gain value (e.g., third weight value $\lambda_m$) to pass medium frequency regions. Finally, the device 110 may determine (640) third gain values $G_{kn}$ associated with the third frequency range 560 (e.g., high frequency range, such as k=$M_2$ to K/2) and divide (645) each of the third gain values $G_{kn}$ by a second value (e.g., fourth weight value $\lambda_h$) to suppress more noise in the higher frequency regions. Thus, the device 110 may concatenate (650) the adjusted gain values to generate output input gain values $G_k$. While FIG. 6 illustrates an example that includes three frequency ranges, the disclosure is not limited thereto and the number of frequency ranges may vary without departing from the disclosure.

FIG. 7 illustrates an example equation used to perform Savitzky-Golay filtering according to embodiments of the present disclosure. As illustrated in FIG. 7, Savitzky-Golay filtering 700 may apply a Savitzky-Golay filter to the smoothened gain in order to remove sudden spikes. This performs a least square fit of a small set of consecutive data points to a polynomial and takes the calculated central point of the fitted polynomial curve as the new smoothed data point.

A set of integers ($A_{-n}$,$A_{-(n-1)}$, . . . $A_{n-1}$, $A_n$) could be derived and used as weighting coefficients to carry out the smoothing operation. The use of these weighting coefficients 710, known as convolution integers (e.g., convolution coefficient values), is exactly equivalent to fitting the data to a polynomial, while computationally more effective and much faster. Therefore, the smoothed data point $(G_k)_s$, by the Savitzky-Golay algorithm is given by the following Savitzky-Golay equation 720:

$$(G_k)_s = \frac{\sum_{i=-n}^{n} A_i G_{k+i}}{\sum_{i=-n}^{n} A_i}, k = 0 \text{ to } K/2 \quad [12]$$

However, smoothing the gain/mask function too much leads to loss of information. Thus, to perform sufficient smoothing so as to remove the distortions, the device 110 may perform frequency grouping 370 to split the obtained mask into different groups. For example, the device 110 may use three different groups of frequency bands, although the number of groups may vary without departing from the disclosure. The device 110 may perform Savitzky-Golay filtering 375 by applying Savitzky-Golay filters independently on the mask groups and then concatenating the final gain values generated by the Savitzky-Golay filters. The order of the Savitzky-Golay filters may vary and may depend on the frequency bands.

Figure 8:
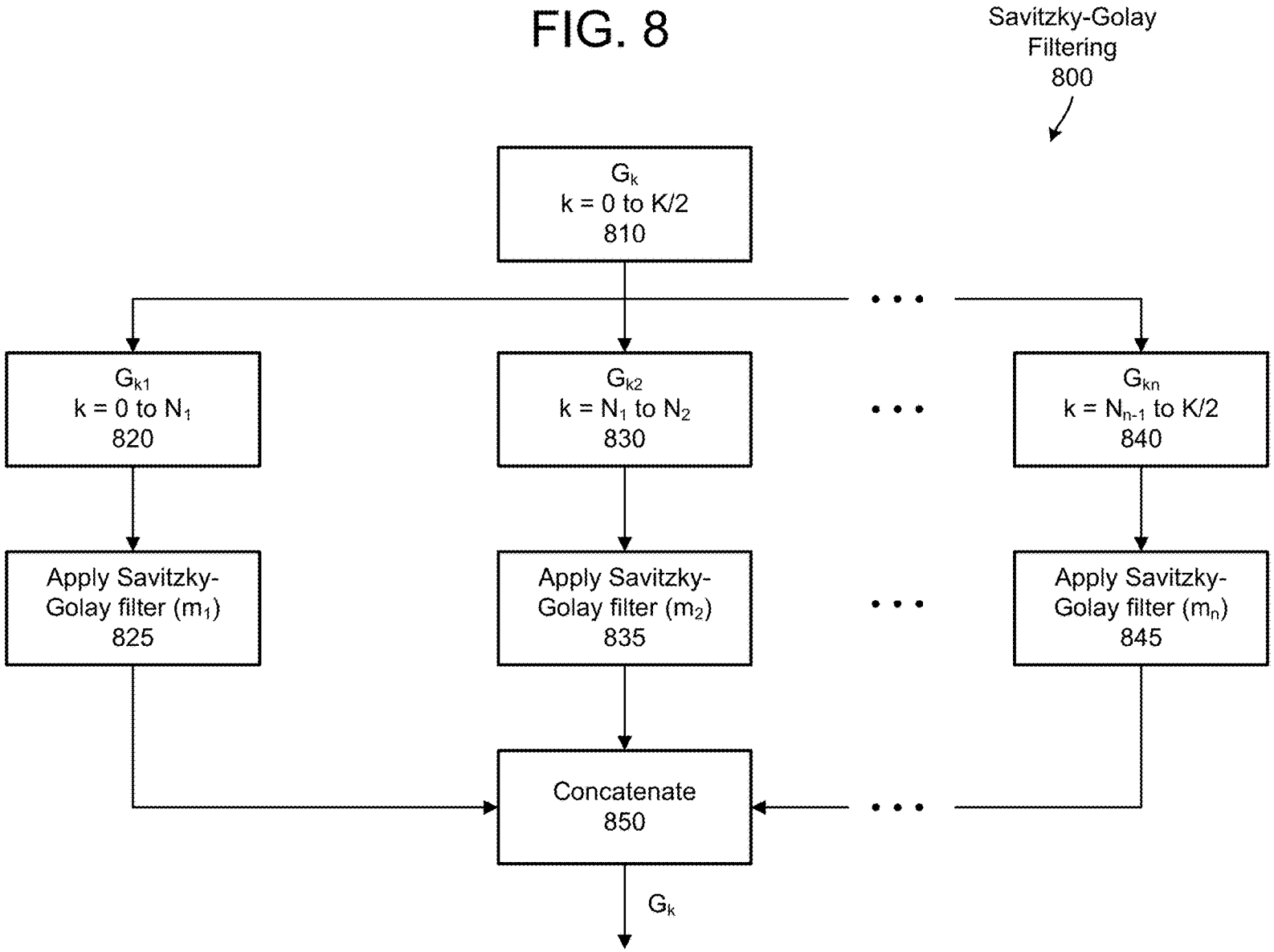
FIG. 8 illustrates an example of performing Savitzky-Golay filtering according to embodiments of the present disclosure.

FIG. 8 illustrates an example of performing Savitzky-Golay filtering according to embodiments of the present disclosure. As illustrated in FIG. 8, during Savitzky-Golay filtering 800 the device 110 may receive (810) input gain values $G_k$ (where k=0 to K/2), split the frequency bins into n frequency ranges, and apply n Savitzky-Golay filters to the n frequency ranges. For example, the device 110 may determine (820) first gain values $G_{ki}$ associated with a first frequency range (e.g., lowest frequency range, such as k=0 to $N_1$) and apply (825) a first Savitzky-Golay filter ($m_1$) to the first gain values Gki. Similarly, the device 110 may determine (830) second gain values $G_{k2}$ associated with a second frequency range (e.g., subsequent frequency range, such as k=$N_1$ to $N_2$) and apply (835) a second Savitzky-Golay filter ($m_2$) to the second gain values $G_{k2}$, and so on. Finally, the device 110 may determine (840) n-th gain values Gkn associated with an n-th frequency range (e.g., highest frequency range, such as k=$N_{n-1}$ to K/2) and apply (845) an n-th Savitzky-Golay filter ($m_n$) to the n-th gain values $G_{kn}$. Thus, the device 110 may concatenate (850) the adjusted gain values to generate output input gain values $G_k$. FIG. 8 illustrates an example that includes n different Savitzky-Golay filters for n frequency ranges in order to illustrate that the number of frequency ranges and/or the individual frequency ranges may vary without departing from the disclosure. For example, while the Savitzky-Golay filtering 800 may apply three different Savitzky-Golay filters (e.g., n=3), the frequency ranges may be different than the examples described above with regard to gain weighting 600 without departing from the disclosure.

The final gain values are combined to generate mask data, which may be in the frequency domain and may be multiplied with the noisy speech spectrum to obtain an estimate of the clean speech spectrum. For example, multiplier 380 may multiply the final derived gain function (e.g., mask data) by the first audio data in the frequency domain to generate second audio data $X'_k$. An inverse window is applied to further smoothen the samples between two frames. Assuming the angle to be the same as that of the noisy speech, the device 110 may convert the second audio data from the frequency domain to the time domain using Inverse Fast Fourier Transform (IFFT)/Synthesis 385 to generate second audio data x'(n) in the time domain. The device 110 may send the second audio data x'(n) (e.g., output enhanced time-domain signal) to a remote device during a communication session (e.g., VoIP).

Figure 9:
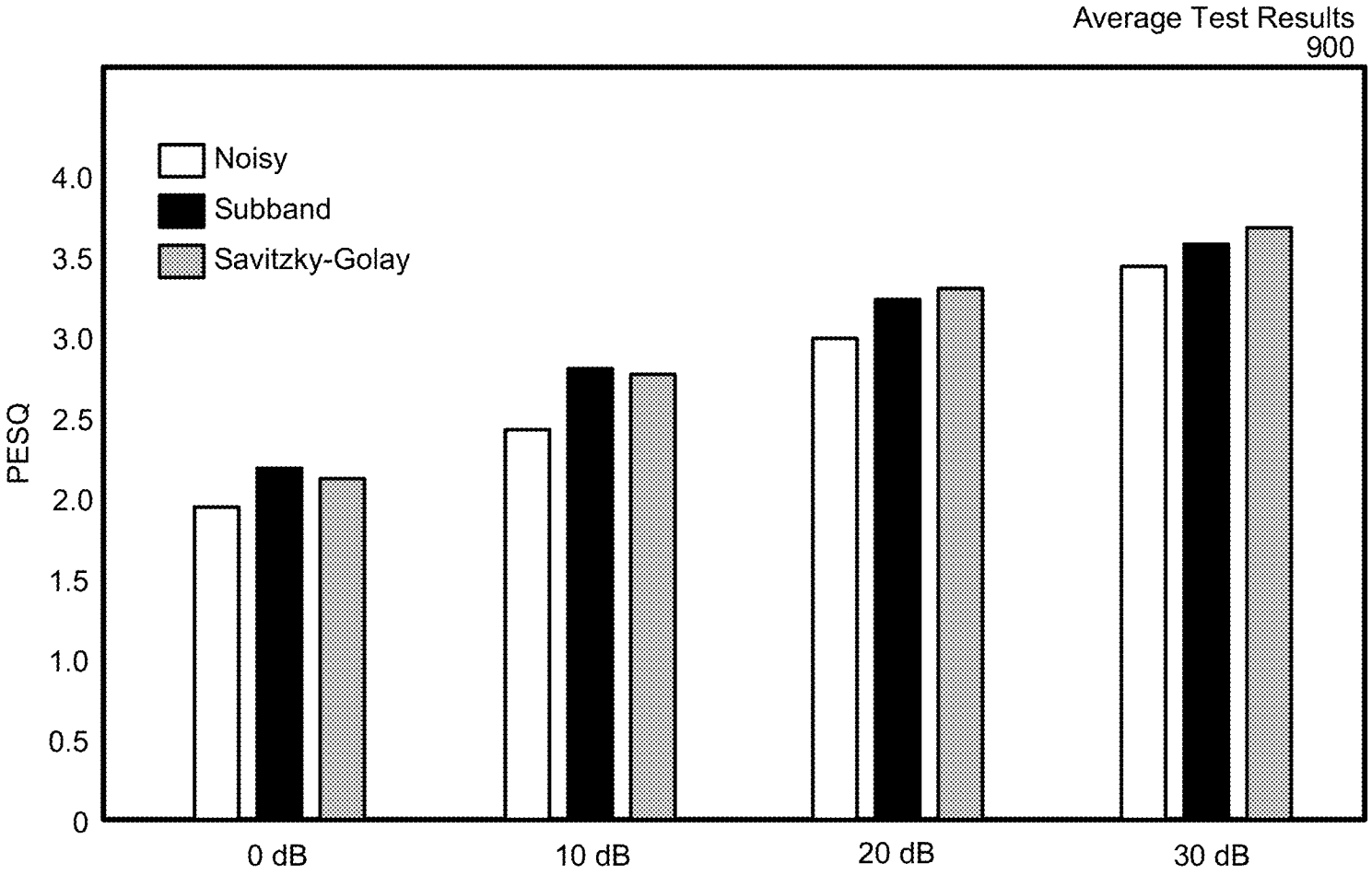
FIG. 9 illustrates an example of test results according to embodiments of the present disclosure.

FIG. 9 illustrates an example of test results according to embodiments of the present disclosure. As illustrated in FIG. 9, the Savitzky-Golay filter implementation (e.g., gray bar charts) is compared with noisy speech (e.g., white bar charts) and a competing subband noise reduction implementation (e.g., black bar charts) for a variety of SNR values. For example, average test results 900 illustrate average PESQ scores using a 10s long sentence added with 6 different types of both stationary and non-stationary noise. As illustrated in the average test results 900, the Savitzky-Golay filter implementation achieves first PESQ scores that are similar to second PESQ scores associated with the subband noise reduction implementation and better than third PESQ scores associated with noisy speech. In addition to achieving PESQ scores similar to the subband noise reduction implementation, the Savitzky-Golay filter implementation achieves its main goal of removing speech distortion in the output speech.

Figure 10:
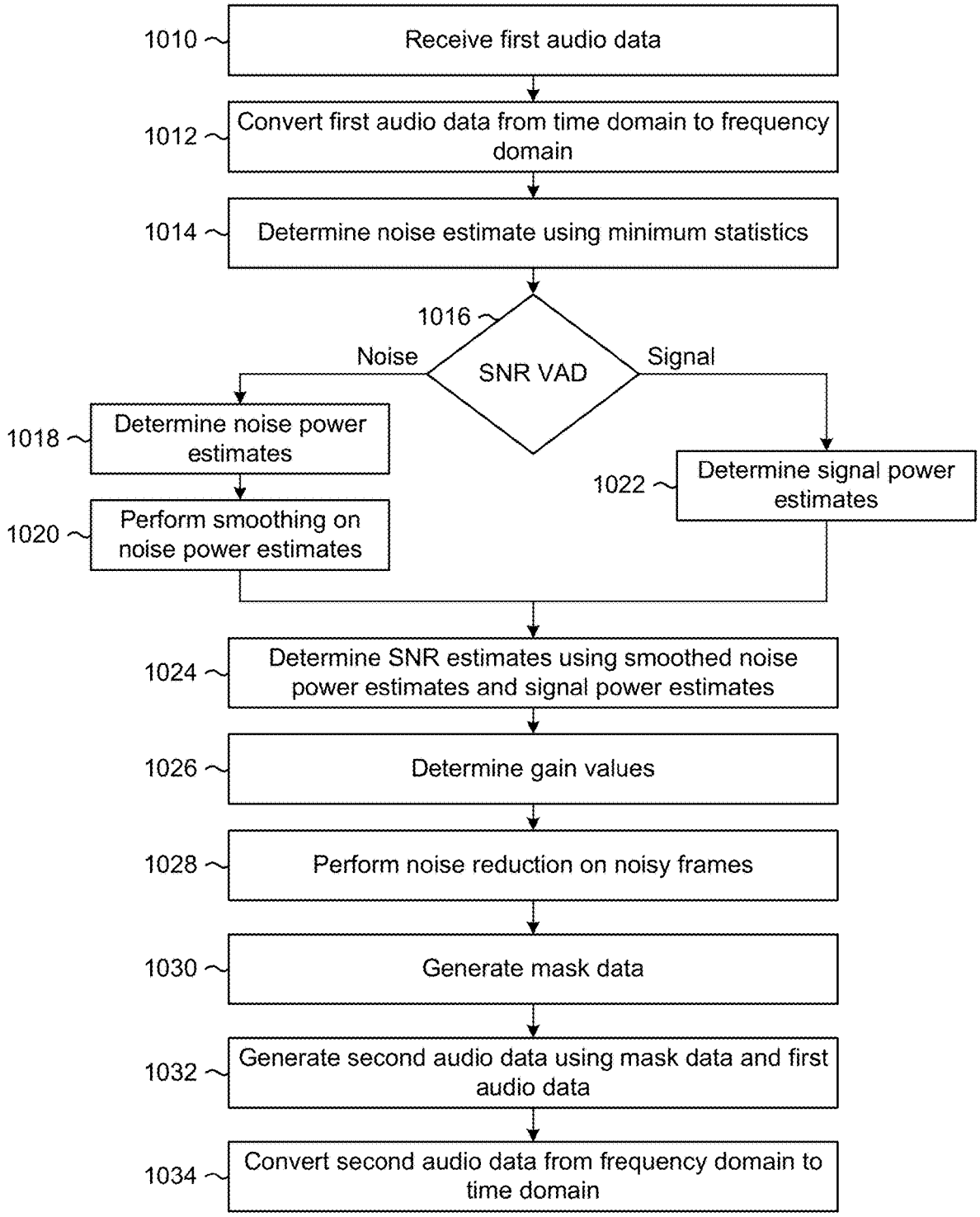
FIG. 10 is a flowchart conceptually illustrating an example method for performing noise reduction according to embodiments of the present disclosure.

FIG. 10 is a flowchart conceptually illustrating an example method for performing noise reduction according to embodiments of the present disclosure. As illustrated in FIG. 10, the device 110 may receive (1010) first audio data and may convert (1012) the first audio data from a time domain to a frequency domain. The device 110 may determine (1014) a noise estimate using minimum statistics and determine (1016) whether an audio frame corresponds to noise or a signal (e.g., speech) using signal-to-noise-ratio (SNR) voice activity detection (VAD).

If the device 110 determines that the audio frame corresponds to noise, the device 110 may determine (1018) noise power estimates and perform (1020) smoothing on the noise power estimates. For example, the device 110 may determine a first noise power estimate for a first frequency band, a second noise power estimate for a second frequency band, and so on, and may perform smoothing to incorporate a noise power estimate from a previous audio frame for each frequency band. In contrast, if the device 110 determines that the audio frame correspond to the signal, the device 110 may determine (1022) signal power estimates without smoothing. For example, the device 110 may determine a first signal power estimate for a first frequency band, a second signal power estimate for a second frequency band, and so on.

The device 110 may determine (1024) SNR estimates using the smoothed noise power estimates and the signal power estimates and may determine (1026) gain values using the SNR estimates. For example, the device 110 may determine a first SNR estimate for the first frequency band using the first smoothed noise power estimate and the first signal power estimate, and may use the first SNR estimate to determine a first gain value associated with the first frequency band.

The device 110 may perform (1028) noise reduction on noisy frames. For example, if the SNR VAD determines that an audio frame corresponds to noise, the device 110 may calculate the gain values associated with the audio frame and then perform noise reduction to reduce the gain values. In some examples, the device 110 may divide the gain values by a noise reduction weight value, although the disclosure is not limited thereto.

The device 110 may generate (1030) mask data, as described in greater detail below with regard to FIG. 11, may generate (1032) second audio data using the mask data and the first audio data, and may convert (1034) the second audio data from the frequency domain to the time domain. In some examples, the device 110 may send the second audio data to a remote device (e.g., the second device 110*b*), although the disclosure is not limited thereto and the device 110 may perform additional processing on the second audio data prior to sending it to the remote device without departing from the disclosure.

Figure 11:
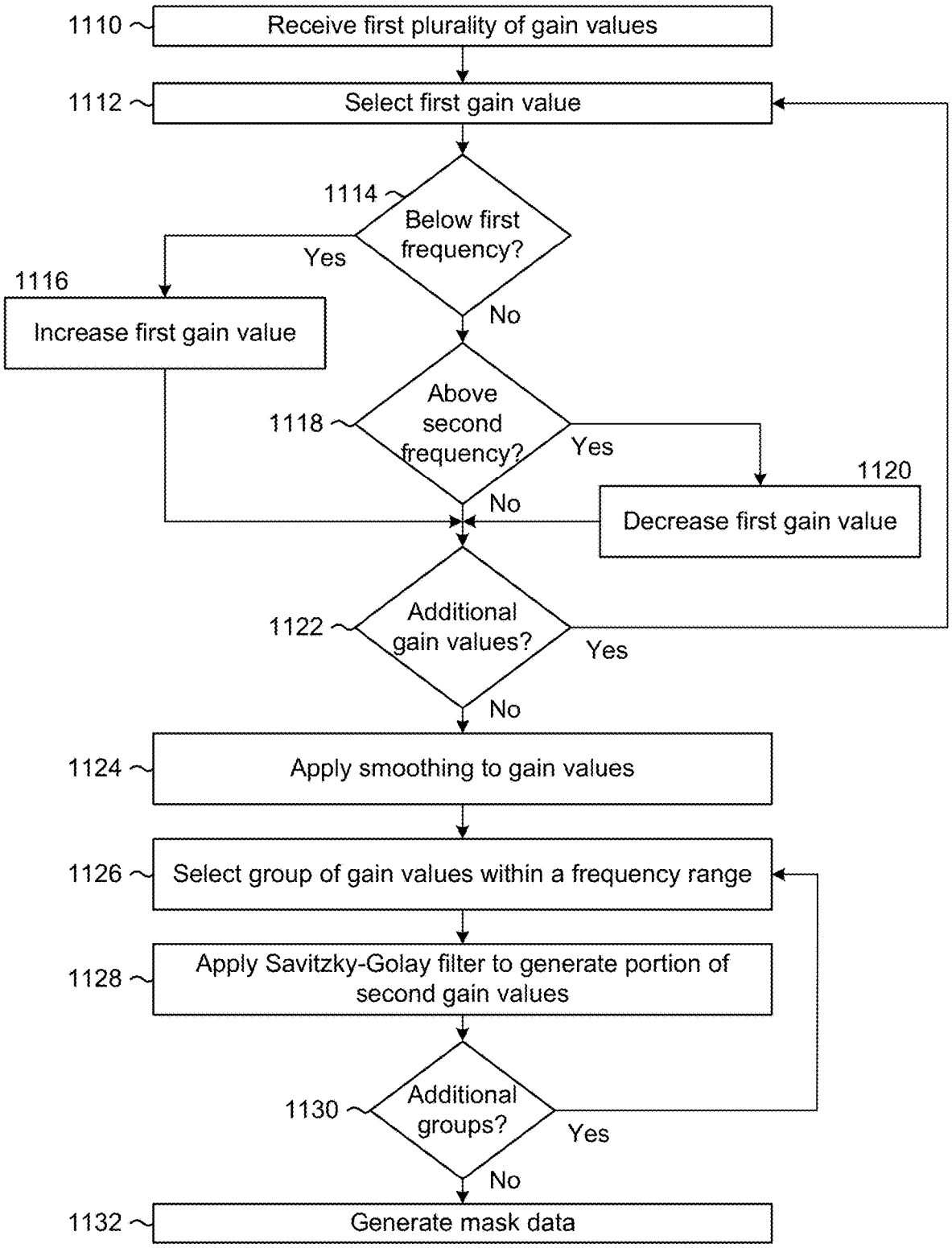
FIG. 11 is a flowchart conceptually illustrating an example method for generating mask data according to embodiments of the present disclosure.

FIG. 11 is a flowchart conceptually illustrating an example method for generating mask data according to embodiments of the present disclosure. As illustrated in FIG. 11, the device 110 may receive (1110) a first plurality of gain values, may select (1112) a first gain value and may determine (1114) whether a first frequency band associated with the first gain value is below a first frequency threshold value. If the first frequency band is below the first frequency threshold value (e.g., satisfies a first condition), the device 110 may increase (1116) the first gain value as described above with regard to gain weighting and illustrated in FIGS. 5B and 6. If the first frequency band is above the first frequency threshold value (e.g., does not satisfy the first condition), the device 110 may determine (1118) whether the first frequency band is above a second frequency threshold value. If the first frequency band is above the second frequency threshold value (e.g., satisfies a second condition), the device 110 may decrease (1120) the first gain value as described above with regard to gain weighting and illustrated in FIGS. 5B and 6. If the first frequency band does not satisfy the first condition or the second condition (e.g., above the first frequency threshold value and below the second frequency threshold value), the first gain value is passed without modification.

The device 110 may determine (1122) whether there are additional gain values in the first plurality of gain values and, if so, may loop to step 1112 to select another gain value as the first gain value. If there are no additional gain values in the first plurality of gain values, the device 110 may apply (1124) smoothing to the gain values, as described above with regard to FIG. 5C.

After the device 110 applies smoothing to each of the gain values, the device 110 may select (1126) a group of gain values within a particular frequency range and may apply (1128) a Savitzky-Golay filter to the selected group of gain values to generate a portion of second gain values, as described in greater detail above with regard to FIGS. 7-8. For example, the device 110 may perform a convolution operation to iteratively select a series of gain values from the group of gain values and multiply the series of gain values by convolution coefficient values associated with the Savitzky-Golay filter, although the disclosure is not limited thereto.

The device 110 may determine (1130) whether there are any additional groups, and if so, may loop to step 1126 to select another group of gain values and repeat step 1128. If there are no additional groups, the device 110 may generate (1132) mask data by concatenating the final gain values generated by the Savitzky-Golay filters in step 1128.

Figure 12:
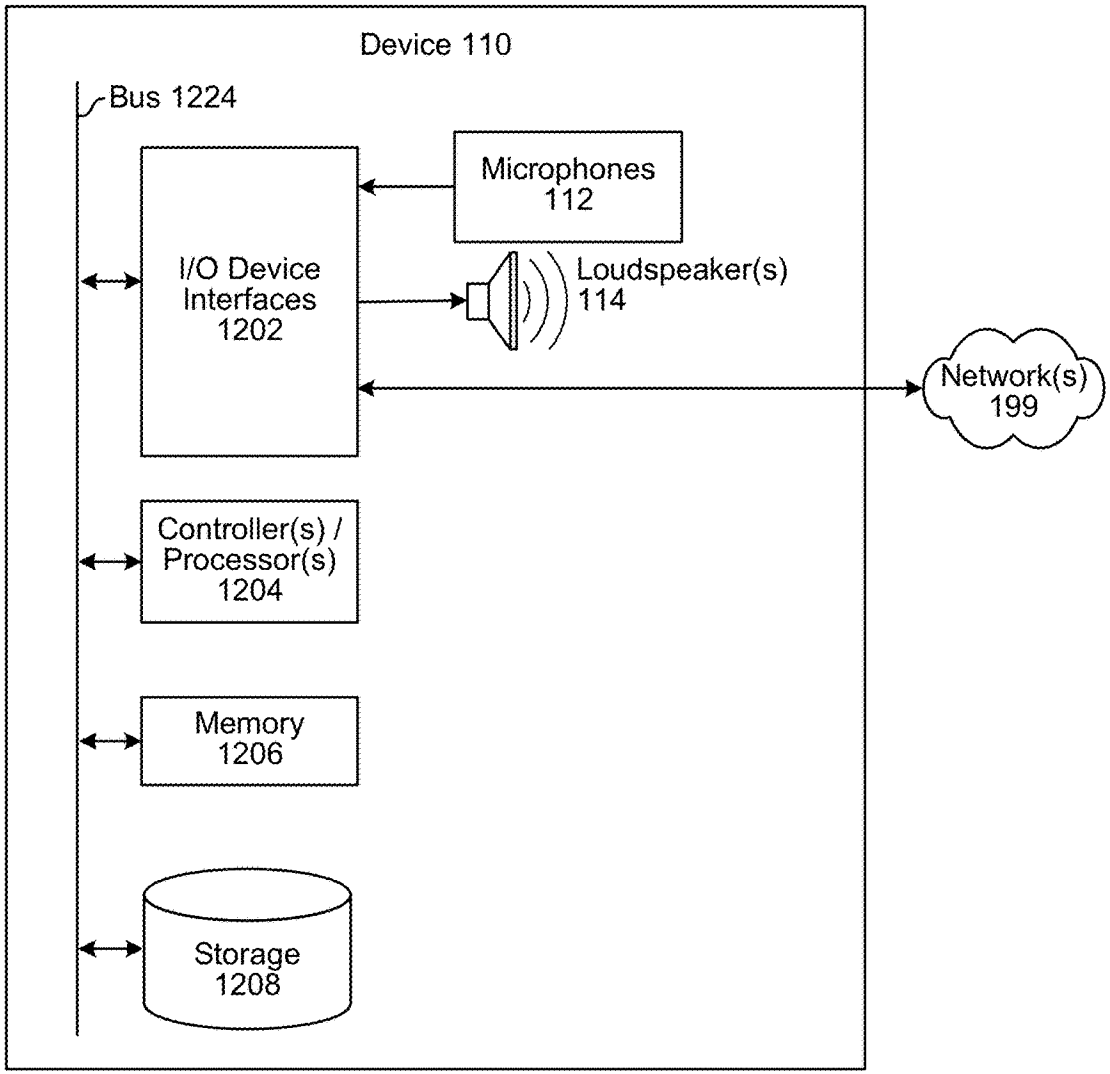
FIG. 12 is a block diagram conceptually illustrating example components of a system according to embodiments of the present disclosure.

FIG. 12 is a block diagram conceptually illustrating example components of a system\according to embodiments of the present disclosure. In operation, the system 100 may include computer-readable and computer-executable instructions that reside on the device 110, as will be discussed further below.

The device 110 may include one or more audio capture device(s), such as a microphone array which may include one or more microphones 112. The audio capture device(s) may be integrated into a single device or may be separate. The device 110 may also include an audio output device for producing sound, such as loudspeaker(s) 114. The audio output device may be integrated into a single device or may be separate.

As illustrated in FIG. 12, the device 110 may include an address/data bus 1224 for conveying data among components of the device 110. Each component within the device 110 may also be directly connected to other components in addition to (or instead of) being connected to other components across the bus 1224.

The device 110 may include one or more controllers/processors 1204, which may each include a central processing unit (CPU) for processing data and computer-readable instructions, and a memory 1206 for storing data and instructions. The memory 1206 may include volatile random access memory (RAM), non-volatile read only memory (ROM), non-volatile magnetoresistive (MRAM) and/or other types of memory. The device 110 may also include a data storage component 1208, for storing data and controller/processor-executable instructions (e.g., instructions to perform operations discussed herein). The data storage component 1208 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1202.

The device 110 includes input/output device interfaces 1202. A variety of components may be connected through the input/output device interfaces 1202. For example, the device 110 may include one or more microphone(s) 112 (e.g., a plurality of microphone(s) 112 in a microphone array), one or more loudspeaker(s) 114, and/or a media source such as a digital media player (not illustrated) that connect through the input/output device interfaces 1202, although the disclosure is not limited thereto. Instead, the number of microphone(s) 112 and/or the number of loudspeaker(s) 114 may vary without departing from the disclosure. In some examples, the microphone(s) 112 and/or loudspeaker(s) 114 may be external to the device 110, although the disclosure is not limited thereto. The input/output interfaces 1202 may include A/D converters (not illustrated) and/or D/A converters (not illustrated).

The input/output device interfaces 1202 may also include an interface for an external peripheral device connection such as universal serial bus (USB), FireWire, Thunderbolt, Ethernet port or other connection protocol that may connect to network(s) 199.

The input/output device interfaces 1202 may be configured to operate with network(s) 199, for example via an Ethernet port, a wireless local area network (WLAN) (such as WiFi), Bluetooth, ZigBee and/or wireless networks, such as a Long Term Evolution (LTE) network, WiMAX network, 3G network, etc. The network(s) 199 may include a local or private network or may include a wide network such as the internet. Devices may be connected to the network(s) 199 through either wired or wireless connections.

The device 110 may include components that may comprise processor-executable instructions stored in storage 1208 to be executed by controller(s)/processor(s) 1204 (e.g., software, firmware, hardware, or some combination thereof). For example, components of the device 110 may be part of a software application running in the foreground and/or background on the device 110. Some or all of the controllers/components of the device 110 may be executable instructions that may be embedded in hardware or firmware in addition to, or instead of, software. In one embodiment, the device 110 may operate using an Android operating system (such as Android 4.3 Jelly Bean, Android 4.4 KitKat or the like), an Amazon operating system (such as FireOS or the like), or any other suitable operating system.

Computer instructions for operating the device 110 and its various components may be executed by the controller(s)/processor(s) 1204, using the memory 1206 as temporary "working" storage at runtime. The computer instructions may be stored in a non-transitory manner in non-volatile memory 1206, storage 1208, or an external device. Alternatively, some or all of the executable instructions may be embedded in hardware or firmware in addition to or instead of software.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, wearable computing devices (watches, glasses, etc.), other mobile devices, video game consoles, speech processing systems, distributed computing environments, etc. Thus the components, components and/or processes described above may be combined or rearranged without departing from the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

Figure 13:
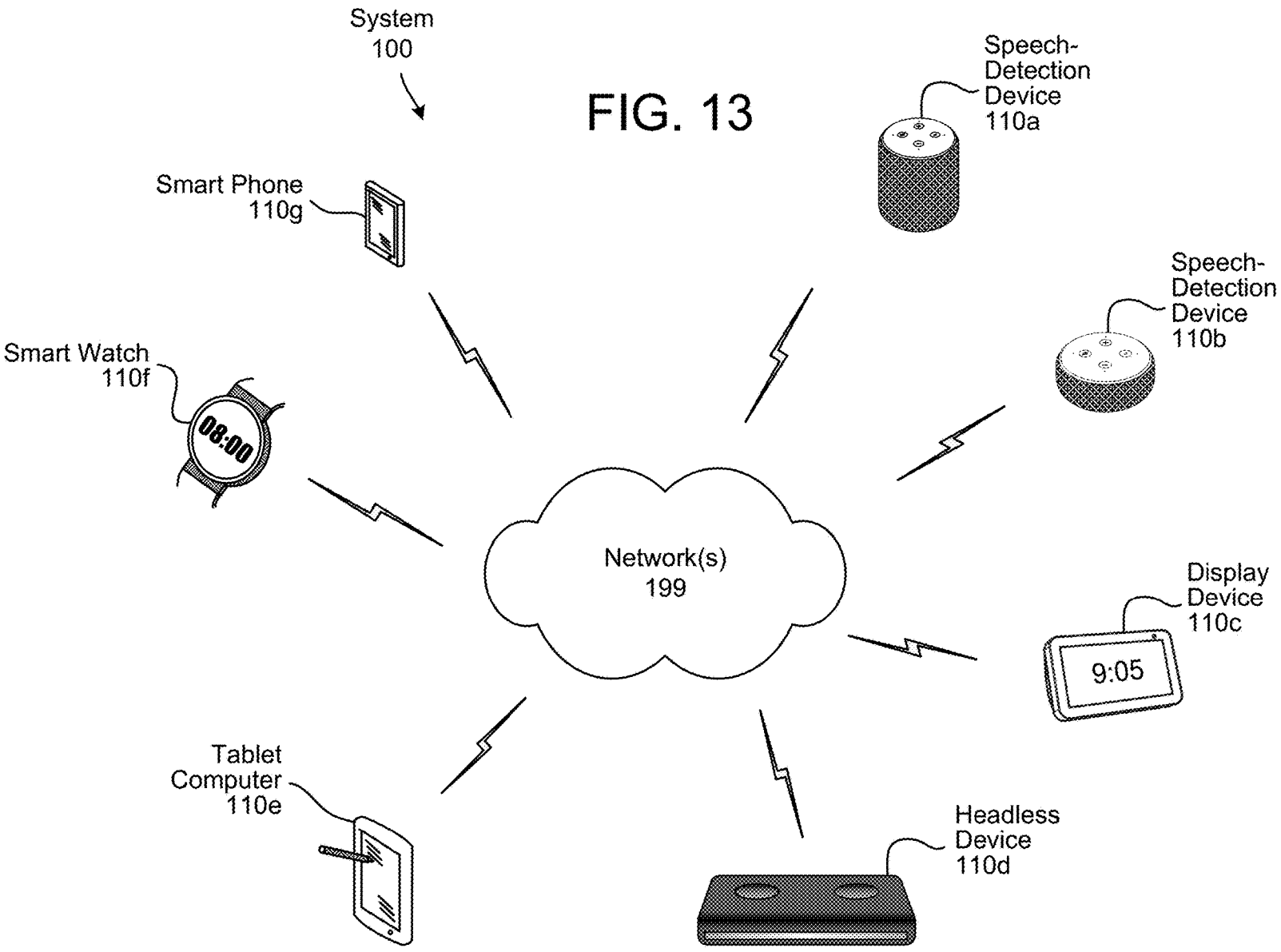
FIG. 13 illustrates an example of a network of devices according to embodiments of the present disclosure.

As illustrated in FIG. 13, the device 110 may correspond to multiple different designs without departing from the disclosure. For example, FIG. 13 illustrates a first speech-detection device 110*a* having a first microphone array (e.g., six microphones), a second speech-detection device 110*b* having a second microphone array (e.g., two microphones), a first display device 110*c*, a headless device 110*d*, a tablet computer 110*e*, a smart watch 110*f*, and a smart phone 110*g*. Each of these devices 110 may apply the tap detection algorithm described above to perform tap detection and detect a physical interaction with the device without departing from the disclosure. While FIG. 13 illustrates specific examples of devices 110, the disclosure is not limited thereto and the device 110 may include any number of microphones without departing from the disclosure.

Additionally or alternatively, multiple devices (110*a*-110*g*) may contain components of the system, and the devices may be connected over a network(s) 199. The network(s) 199 may include a local or private network or may include a wide network such as the Internet. Devices may be connected to the network(s) 199 through either wired or wireless connections without departing from the disclosure. For example, some of the devices 110 may be connected to the network(s) 199 through a wireless service provider, over a WiFi or cellular network connection, and/or the like, although the disclosure is not limited thereto.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the fixed beamformer, acoustic echo canceller (AEC), adaptive noise canceller (ANC) unit, residual echo suppression (RES), double-talk detector, etc. may be implemented by a digital signal processor (DSP).

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving, by a first device, first audio data;

determining, using the first audio data, first gain values;

generating second gain values using a first number of the first gain values and first convolution coefficient values associated with a least-squares method, wherein the first number of the first gain values are associated with a first frequency range;

generating third gain values using a second number of the first gain values and second convolution coefficient values associated with the least-squares method, wherein the second number of the first gain values are associated with a second frequency range;

generating mask data using the second gain values and the third gain values; and generating second audio data using the first audio data and the mask data.

2. The computer-implemented method of claim 1, wherein the first convolution coefficient values are associated with a first Savitzky-Golay filter.

3. The computer-implemented method of claim 1, wherein generating the second audio data further comprises multiplying the mask data with the first audio data to generate the second audio data, the method further comprising:

generating third audio data by converting the second audio data from a frequency domain to a time domain; and sending the third audio data to a second device.

4. The computer-implemented method of claim 1, wherein determining the first gain values further comprises:

determining that an audio frame of the first audio data corresponds to noise;

determining, using the audio frame, a signal quality metric value associated with a third frequency range within the first frequency range;

determining, using the signal quality metric, a first gain value associated with the third frequency range; and determining a second gain value of the first gain values by dividing the first gain value by a first value.

5. The computer-implemented method of claim 1, wherein the first gain values include a first value and a second value, the method further comprises:

determining a first gain value associated with a third frequency range within the first frequency range;

determining a second gain value associated with a fourth frequency range, wherein the fourth frequency range is within the second frequency range;

determining that a maximum frequency within the third frequency range is below a first frequency cutoff value;

determining the first value by multiplying the first gain value by a first weight value;

determining that a minimum frequency within the fourth frequency range is above a second frequency cutoff value; and determining the second value by dividing the second gain value by a second weight value.

6. The computer-implemented method of claim 1, further comprising:

determining that a first audio frame of the first audio data corresponds to noise;

determining, using the first audio frame, a first power value associated with a third frequency range; and determining, using the first power value, a noise estimate value associated with the third frequency range.

7. The computer-implemented method of claim 6, further comprising:

determining that a second audio frame of the first audio data corresponds to speech;

determining, using the second audio frame, a second power value associated with the third frequency range;

determining, using the second power value, a signal estimate value associated with the third frequency range;

determining, using the noise estimate value and the signal estimate value, a signal quality metric value associated with the third frequency range; and generating a first value of the first gain values using the signal quality metric value.

8. The computer-implemented method of claim 1, further comprising:

determining a noise estimate value associated with a third frequency range within the first frequency range;

determining a signal estimate value associated with the third frequency range;

determining, using the noise estimate value and the signal estimate value, a signal quality metric value associated with the third frequency range; and generating a first value of the first gain values using the signal quality metric value.

9. The computer-implemented method of claim 1, wherein determining the first gain values further comprises:

determining, using the first audio data, a noise estimate value associated with a third frequency range;

determining, using the first audio data, a signal estimate value associated with the third frequency range;

determining, using the noise estimate value and the signal estimate value, a signal quality metric value associated with the third frequency range; and generating a first value of the first gain values using the signal quality metric value.

10. A system comprising:

at least one processor; and memory including instructions operable to be executed by the at least one processor to cause the system to:

receive, by a first device, first audio data;

determine, using the first audio data, first gain values;

generate second gain values using a first number of the first gain values and first convolution coefficient values associated with a least-squares method, wherein the first number of the first gain values are associated with a first frequency range;

generate third gain values using a second number of the first gain values and second convolution coefficient values associated with the least-squares method, wherein the second number of the first gain values are associated with a second frequency range;

generate mask data using the second gain values and the third gain values; and generate second audio data using the first audio data and the mask data.

11. The system of claim 10, wherein the first convolution coefficient values are associated with a first Savitzky-Golay filter.

12. The system of claim 10, wherein the memory further comprises instructions that, when executed by the at least one processor, further cause the system to:

generate third audio data by converting the second audio data from a frequency domain to a time domain; and send the third audio data to a second device.

13. The system of claim 10, wherein the memory further comprises instructions that, when executed by the at least one processor, further cause the system to:

determine that an audio frame of the first audio data corresponds to noise;

determine, using the audio frame, a signal quality metric value associated with a third frequency range within the first frequency range;

determine, using the signal quality metric, a first gain value associated with the third frequency range; and determine a second gain value of the first gain values by dividing the first gain value by a first value.

14. The system of claim 10, wherein the first gain values include a first value and a second value, and the memory further comprises instructions that, when executed by the at least one processor, further cause the system to:

determine a first gain value associated with a third frequency range within the first frequency range;

determine a second gain value associated with a fourth frequency range within the second frequency range;

determine that a maximum frequency within the third frequency range is below a first frequency cutoff value;

determine the first value by multiplying the first gain value by a first weight value;

determine that a minimum frequency within the fourth frequency range is above a second frequency cutoff value; and determine the second value by dividing the second gain value by a second weight value.

15. The system of claim 10, wherein the memory further comprises instructions that, when executed by the at least one processor, further cause the system to:

determine that a first audio frame of the first audio data corresponds to noise;

determine, using the first audio frame, a first power value associated with a third frequency range; and determine, using the first power value, a noise estimate value associated with the third frequency range.

16. The system of claim 15, wherein the memory further comprises instructions that, when executed by the at least one processor, further cause the system to:

determine that a second audio frame of the first audio data corresponds to speech;

determine, using the second audio frame, a second power value associated with the third frequency range;

determine, using the second power value, a signal estimate value associated with the third frequency range;

determine, using the noise estimate value and the signal estimate value, a signal quality metric value associated with the third frequency range; and generate a first value of the first gain values using the signal quality metric value.

17. The system of claim 10, wherein the memory further comprises instructions that, when executed by the at least one processor, further cause the system to:

determine a noise estimate value associated with a third frequency range within the first frequency range;

determine a signal estimate value associated with the third frequency range;

determine, using the noise estimate value and the signal estimate value, a signal quality metric value associated with the third frequency range; and generate a first value of the first gain values using the signal quality metric value.

18. The system of claim 10, wherein the memory further comprises instructions that, when executed by the at least one processor, further cause the system to:

determine, using the first audio data, a noise estimate value associated with a third frequency range;

determine, using the first audio data, a signal estimate value associated with the third frequency range;

determine, using the noise estimate value and the signal estimate value, a signal quality metric value associated with the third frequency range; and generate a first value of the first gain values using the signal quality metric value.

19. A computer-implemented method, the method comprising:

receiving, by a first device, first audio data;

determining, using the first audio data, first gain values;

generating second gain values using a first number of the first gain values and a first Savitzky-Golay filter, wherein the first number of the first gain values are associated with a first frequency range;

generating third gain values using a second number of the first gain values and a second Savitzky-Golay filter, wherein the second number of the first gain values are associated with a second frequency range;

generating mask data using the second gain values and the third gain values; and generating second audio data using the first audio data and the mask data.

20. The computer-implemented method of claim 19, further comprising:

determining a noise estimate value associated with a third frequency range within the first frequency range;

determining a signal estimate value associated with the third frequency range;

determining, using the noise estimate value and the signal estimate value, a signal quality metric value associated with the third frequency range; and generating a first value of the first gain values using the signal quality metric value.

* * * * *